US008003168B2

(12) United States Patent
Oldorff

(10) Patent No.: US 8,003,168 B2
(45) Date of Patent: Aug. 23, 2011

(54) METHOD FOR SEALING A BUILDING PANEL

(75) Inventor: Frank Oldorff, Schwerin (DE)

(73) Assignee: Kronotec AG, Luzern (CH)

( * ) Notice: Subject to any disclaimer, the term of this patent is extended or adjusted under 35 U.S.C. 154(b) by 1127 days.

(21) Appl. No.: 10/932,337

(22) Filed: Sep. 2, 2004

(65) Prior Publication Data

US 2005/0089644 A1 Apr. 28, 2005

(30) Foreign Application Priority Data

Sep. 6, 2003 (DE) ..... 103 41 172

(51) Int. Cl.
*B27N 3/24* (2006.01)
*B27N 3/26* (2006.01)
*B05D 3/12* (2006.01)

(52) U.S. Cl. ..... 427/370; 427/202; 427/203; 427/205; 427/408

(58) Field of Classification Search ..... 427/202, 427/203, 205, 355, 369, 370, 375, 408; 264/119, 264/319, 320
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Riddler |
| 3,203,149 | A | 8/1965 | Soddy |
| 3,204,380 | A | 9/1965 | Smith et al. |
| 3,267,630 | A | 8/1966 | Omholt |
| 3,282,010 | A | 11/1966 | King, Jr. |
| 3,286,006 | A | 11/1966 | Annand |
| 3,310,919 | A | 3/1967 | Bue et al. |

(Continued)

FOREIGN PATENT DOCUMENTS

| | | |
|---|---|---|
| AT | 005566 | 8/2002 |

(Continued)

OTHER PUBLICATIONS

German Patent and Trademark Office communication citing EP 1 321 598 A2 (2 pages).

(Continued)

*Primary Examiner* — William Phillip Fletcher, III
(74) *Attorney, Agent, or Firm* — Andrew M. Calderon; Roberts Mlotkowski Safran & Cole, P.C.

(57) ABSTRACT

The solution of the problem is arrived at through the following steps:

a) applying liquid resin to the top side,
b) drying the resin,
c) pressing the construction plate under the influence of temperature, so that the resin at least partially melts, wherein the pressing may be performed in a continuous press.

22 Claims, No Drawings

U.S. PATENT DOCUMENTS

| | | | | |
|---|---|---|---|---|
| 3,347,048 | A | | 10/1967 | Brown et al. |
| 3,460,304 | A | | 8/1969 | Braeuninger et al. |
| 3,481,810 | A | | 12/1969 | Waite |
| 3,526,420 | A | | 9/1970 | Brancaleone |
| 3,538,665 | A | | 11/1970 | Gohner |
| 3,553,919 | A | | 1/1971 | Omholt |
| 3,555,762 | A | | 1/1971 | Costanzo, Jr. |
| 3,608,258 | A | | 9/1971 | Spratt |
| 3,694,983 | A | | 10/1972 | Couquet |
| 3,714,747 | A | | 2/1973 | Curran |
| 3,720,027 | A | | 3/1973 | Christensen |
| 3,731,445 | A | | 5/1973 | Hoffmann et al. |
| 3,759,007 | A | | 9/1973 | Thiele |
| 3,760,548 | A | | 9/1973 | Sauer et al. |
| 3,768,846 | A | | 10/1973 | Hensley et al. |
| 3,851,685 | A | * | 12/1974 | Ahrweiler et al. ..... 100/154 |
| 3,853,578 | A | | 12/1974 | Suzuki et al. |
| 3,859,000 | A | | 1/1975 | Webster |
| 3,878,030 | A | | 4/1975 | Cook |
| 3,902,293 | A | | 9/1975 | Witt et al. |
| 3,908,053 | A | | 9/1975 | Hettich |
| 3,912,569 | A | | 10/1975 | Kapral |
| 3,936,551 | A | | 2/1976 | Elmendorf et al. |
| 3,988,187 | A | | 10/1976 | Witt et al. |
| 4,006,048 | A | | 2/1977 | Cannady, Jr. et al. |
| 4,090,338 | A | | 5/1978 | Bourgade |
| 4,091,136 | A | | 5/1978 | O'Brian et al. |
| 4,099,358 | A | | 7/1978 | Compaan |
| 4,118,533 | A | | 10/1978 | Hipchen et al. |
| 4,131,705 | A | | 12/1978 | Kubinsky |
| 4,164,832 | A | | 8/1979 | Van Zandt |
| 4,169,688 | A | | 10/1979 | Toshio |
| 4,237,087 | A | * | 12/1980 | Jones ..... 264/134 |
| 4,242,390 | A | | 12/1980 | Nemeth |
| 4,243,716 | A | | 1/1981 | Kosaka et al. |
| 4,245,689 | A | | 1/1981 | Grard et al. |
| 4,246,310 | A | | 1/1981 | Hunt et al. |
| 4,290,248 | A | | 9/1981 | Kemerer et al. |
| 4,299,070 | A | | 11/1981 | Oltmanns et al. |
| 4,426,820 | A | | 1/1984 | Terbrack et al. |
| 4,431,044 | A | | 2/1984 | Bruneau |
| 4,471,012 | A | | 9/1984 | Maxwell |
| 4,501,102 | A | | 2/1985 | Knowles |
| 4,520,062 | A | | 5/1985 | Ungar et al. |
| 4,561,233 | A | | 12/1985 | Harter et al. |
| 4,585,685 | A | | 4/1986 | Forry et al. |
| 4,599,127 | A | * | 7/1986 | Cannady et al. ..... 156/289 |
| 4,612,745 | A | | 9/1986 | Hovde |
| 4,641,469 | A | | 2/1987 | Wood |
| 4,653,242 | A | | 3/1987 | Ezard |
| 4,654,244 | A | | 3/1987 | Eckert et al. |
| 4,703,597 | A | | 11/1987 | Eggemar |
| 4,715,162 | A | | 12/1987 | Brightwell |
| 4,738,071 | A | | 4/1988 | Ezard |
| 4,752,497 | A | | 6/1988 | McConkey et al. |
| 4,756,951 | A | | 7/1988 | Wang et al. |
| 4,769,963 | A | | 9/1988 | Meyerson |
| 4,819,932 | A | | 4/1989 | Trotter, Jr. |
| 4,831,806 | A | | 5/1989 | Niese et al. |
| 4,845,907 | A | | 7/1989 | Meek |
| 4,849,768 | A | | 7/1989 | Graham |
| 4,905,442 | A | | 3/1990 | Daniels |
| 4,947,602 | A | | 8/1990 | Pollasky |
| 5,029,425 | A | | 7/1991 | Bogataj |
| 5,064,592 | A | * | 11/1991 | Ueda et al. ..... 264/112 |
| 5,103,614 | A | | 4/1992 | Kawaguchi et al. |
| 5,113,632 | A | | 5/1992 | Hanson |
| 5,117,603 | A | | 6/1992 | Weintraub |
| 5,136,823 | A | | 8/1992 | Pellegrino |
| 5,138,622 | A | * | 8/1992 | Friede et al. ..... 372/38.03 |
| 5,165,816 | A | | 11/1992 | Parasin |
| 5,179,812 | A | | 1/1993 | Hill |
| 5,205,091 | A | | 4/1993 | Brown |
| 5,216,861 | A | | 6/1993 | Meyerson |
| 5,251,996 | A | | 10/1993 | Hiller et al. |
| 5,253,464 | A | | 10/1993 | Nilsen |
| 5,283,102 | A | | 2/1994 | Sweet et al. |
| 5,295,341 | A | | 3/1994 | Kajiwara |
| 5,335,473 | A | | 8/1994 | Chase |
| 5,348,778 | A | | 9/1994 | Knipp et al. |
| 5,349,796 | A | | 9/1994 | Meyerson |
| 5,390,457 | A | | 2/1995 | Sjölander |
| 5,391,340 | A | * | 2/1995 | Mirous et al. ..... 264/112 |
| 5,413,834 | A | | 5/1995 | Hunter et al. |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,567,497 | A | | 10/1996 | Zegler et al. |
| 5,570,554 | A | | 11/1996 | Searer |
| 5,597,024 | A | | 1/1997 | Bolyard et al. |
| 5,630,304 | A | | 5/1997 | Austin |
| 5,653,099 | A | | 8/1997 | MacKenzie |
| 5,671,575 | A | | 9/1997 | Wu |
| 5,694,734 | A | | 12/1997 | Cercone et al. |
| 5,706,621 | A | | 1/1998 | Pervan |
| 5,736,227 | A | | 4/1998 | Sweet et al. |
| 5,768,850 | A | | 6/1998 | Chen |
| 5,797,175 | A | | 8/1998 | Schneider |
| 5,797,237 | A | | 8/1998 | Finkell, Jr. |
| 5,823,240 | A | | 10/1998 | Bolyard et al. |
| 5,827,592 | A | | 10/1998 | Van Gulik et al. |
| 5,860,267 | A | | 1/1999 | Pervan |
| 5,935,668 | A | | 8/1999 | Smith |
| 5,943,239 | A | | 8/1999 | Shamblin et al. |
| 5,953,878 | A | | 9/1999 | Johnson |
| 5,968,625 | A | | 10/1999 | Hudson |
| 5,985,397 | A | | 11/1999 | Witt et al. |
| 5,987,839 | A | | 11/1999 | Hamar et al. |
| 6,006,486 | A | | 12/1999 | Moriau et al. |
| 6,023,907 | A | | 2/2000 | Pervan |
| 6,065,262 | A | | 5/2000 | Motta |
| 6,094,882 | A | | 8/2000 | Pervan |
| 6,101,778 | A | | 8/2000 | Martensson |
| 6,119,423 | A | | 9/2000 | Costantino |
| 6,134,854 | A | | 10/2000 | Stanchfield |
| 6,148,884 | A | | 11/2000 | Bolyard et al. |
| 6,165,308 | A | * | 12/2000 | Chen et al. ..... 156/289 |
| 6,168,866 | B1 | | 1/2001 | Clark |
| 6,173,540 | B1 | | 1/2001 | Spivey |
| 6,174,360 | B1 | * | 1/2001 | Sliwinski et al. ..... 106/453 |
| 6,182,410 | B1 | | 2/2001 | Pervan |
| 6,186,703 | B1 | | 2/2001 | Shaw |
| 6,205,639 | B1 | | 3/2001 | Pervan |
| 6,209,278 | B1 | | 4/2001 | Tychsen |
| 6,216,403 | B1 | | 4/2001 | Belbeoc'h |
| 6,216,409 | B1 | | 4/2001 | Roy et al. |
| D442,296 | S | | 5/2001 | Külik |
| D442,297 | S | | 5/2001 | Külik |
| D442,298 | S | | 5/2001 | Külik |
| D442,706 | S | | 5/2001 | Külik |
| D442,707 | S | | 5/2001 | Külik |
| 6,224,698 | B1 | | 5/2001 | Endo |
| 6,238,798 | B1 | | 5/2001 | Kang et al. |
| 6,247,285 | B1 | | 6/2001 | Moebus |
| D449,119 | S | | 10/2001 | Külik |
| D449,391 | S | | 10/2001 | Külik |
| D449,392 | S | | 10/2001 | Külik |
| 6,324,803 | B1 | | 12/2001 | Pervan |
| 6,345,481 | B1 | | 2/2002 | Nelson |
| 6,363,677 | B1 | | 4/2002 | Chen et al. |
| 6,397,547 | B1 | | 6/2002 | Martensson |
| 6,418,683 | B1 | | 7/2002 | Martensson et al. |
| 6,421,970 | B1 | | 7/2002 | Martensson et al. |
| 6,427,408 | B1 | | 8/2002 | Krieger |
| 6,436,159 | B1 | | 8/2002 | Safta et al. |
| 6,438,919 | B1 | | 8/2002 | Knauseder |
| 6,446,405 | B1 | | 9/2002 | Pervan |
| 6,449,913 | B1 | | 9/2002 | Shelton |
| 6,449,918 | B1 | | 9/2002 | Nelson |
| 6,453,632 | B1 | | 9/2002 | Huang |
| 6,458,232 | B1 | | 10/2002 | Valentinsson |
| 6,460,306 | B1 | | 10/2002 | Nelson |
| 6,461,636 | B1 | | 10/2002 | Arth et al. |
| 6,465,046 | B1 | | 10/2002 | Hansson et al. |
| 6,490,836 | B1 | | 12/2002 | Moriau et al. |

6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pervan
6,546,691 B2 4/2003 Peopolder
6,553,724 B1 4/2003 Bigler
6,558,754 B1 5/2003 Velin et al.
6,565,919 B1 5/2003 Hansson et al.
6,568,148 B1 5/2003 Eisermann
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,681,820 B2 1/2004 Olofsson
6,682,254 B1 1/2004 Olofsson et al.
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,775,545 B2 8/2004 Chen et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0160680 A1 10/2002 Laurence et al.
2003/0024190 A1* 2/2003 Stanchfield ..... 52/287.1
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.
2004/0250493 A1 12/2004 Thiers et al.
2004/0255541 A1 12/2004 Thiers et al.
2004/0258907 A1 12/2004 Kornfalt et al.
2005/0003149 A1 1/2005 Kornfalt et al.
2005/0016099 A1 1/2005 Thiers
2005/0266200 A1* 12/2005 Padmanabhan ..... 428/54

FOREIGN PATENT DOCUMENTS

AU 713628 5/1998
AU 200 020703 1/2000
BE 417526 9/1936
BE 557844 6/1957
BE 557844 3/1960
BE 09 600527 6/1998
BE 09 700344 10/1998
CA 991373 6/1976
CA 2226286 12/1997
CA 2252791 5/1999
CA 2 289309 7/2000
CH 200949 1/1939
CH 211877 1/1941
CH 414 524 A 6/1966
CH 562377 5/1975
DE 314207 9/1919
DE 531989 8/1931
DE 740235 10/1943
DE 1089966 9/1960
DE 1 534278 2/1966
DE 1212225 3/1966
DE 1212275 3/1966
DE 1534802 4/1970
DE 7 102476 6/1971
DE 7102476 6/1971
DE 2007129 9/1971
DE 1534278 11/1971
DE 2 252643 10/1972
DE 2238660 2/1974
DE 7402354 5/1974
DE 2502992 7/1976
DE 2616077 10/1977
DE 2917025 11/1980
DE 7911924 3/1981
DE 7928703 5/1981
DE 3041781 6/1982
DE 3214207 11/1982
DE 8226153 1/1983
DE 3343601 6/1985
DE 86 040049 6/1986
DE 3512204 10/1986
DE 3 246376 2/1987
DE 4004891 9/1990
DE 37 35 368 C2 7/1991
DE 4002547 8/1991
DE 4134452 4/1993
DE 4215273 11/1993
DE 4242530 6/1994
DE 4011656 1/1995
DE 4324137 1/1995
DE 4107151 2/1995
DE 29 517128 2/1996
DE 4242530 9/1996
DE 691 18 202 T2 11/1996
DE 3544845 12/1996
DE 29 710175 9/1997
DE 19 616510 3/1998
DE 19 651149 6/1998
DE 19 709641 9/1998
DE 19 718319 11/1998
DE 198 36 789 A1 * 2/2000
DE 19 735189 6/2000

| | | | | |
|---|---|---|---|---|
| DE | 20 001225 | | | 8/2000 |
| DE | 19 925248 | | | 12/2000 |
| DE | 20 017461 | | | 3/2001 |
| DE | 20 018284 | | | 3/2001 |
| DE | 20206460 | | | 8/2002 |
| DE | 102 45 914 | A1 | | 4/2004 |
| DE | 20 218331 | | | 5/2004 |
| EP | 0 248127 | | | 12/1987 |
| EP | 0248127 | | | 12/1987 |
| EP | 0623724 | | | 11/1994 |
| EP | 0652340 | | | 5/1995 |
| EP | 0667936 | | | 8/1995 |
| EP | 0 690185 | | | 1/1996 |
| EP | 0849416 | | | 6/1998 |
| EP | 0698162 | | | 9/1998 |
| EP | 0903451 | | | 3/1999 |
| EP | 0855482 | | | 12/1999 |
| EP | 0877130 | | | 1/2000 |
| EP | 0969163 | | | 1/2000 |
| EP | 0969164 | | | 1/2000 |
| EP | 0974713 | | | 1/2000 |
| EP | 0843763 | | | 10/2000 |
| EP | 1200690 | | | 5/2002 |
| EP | 1 321 598 | A2 | | 6/2003 |
| EP | 0958441 | | | 7/2003 |
| EP | 1026341 | | | 8/2003 |
| EP | 1 454 763 | A2 | | 8/2004 |
| EP | 1 568 489 | A1 | | 8/2005 |
| ES | 163421 | | | 9/1968 |
| ES | 460194 | | | 5/1978 |
| ES | 283331 | | | 5/1985 |
| ES | 1019585 | | | 12/1991 |
| ES | 1019585 | | | 4/1992 |
| ES | 2168045 | | | 5/2002 |
| FI | 843060 | | | 8/1984 |
| FR | 1293043 | | | 4/1962 |
| FR | 2691491 | | | 11/1983 |
| FR | 2568295 | | | 5/1986 |
| FR | 2623544 | | | 5/1989 |
| FR | 2630149 | | | 10/1989 |
| FR | 2637932 | | | 4/1990 |
| FR | 2675174 | | | 10/1991 |
| FR | 2667639 | | | 4/1992 |
| FR | 2691491 | | | 11/1993 |
| FR | 2697275 | | | 4/1994 |
| FR | 2 712329 | | | 5/1995 |
| FR | 2776956 | | | 10/1999 |
| FR | 2781513 | | | 1/2000 |
| FR | 2785633 | | | 5/2000 |
| GB | 424057 | | | 2/1935 |
| GB | 585205 | | | 1/1947 |
| GB | 599793 | | | 3/1948 |
| GB | 636423 | | | 4/1950 |
| GB | 812671 | | | 4/1959 |
| GB | 1033866 | | | 6/1966 |
| GB | 1034117 | | | 6/1966 |
| GB | 1044846 | | | 10/1966 |
| GB | 1237744 | | | 6/1968 |
| GB | 1127915 | | | 9/1968 |
| GB | 1151053 | | * | 5/1969 |
| GB | 1275511 | | | 5/1972 |
| GB | 1399402 | | | 7/1975 |
| GB | 1430423 | | | 3/1976 |
| GB | 1579661 | | * | 11/1980 |
| GB | 2117813 | | | 10/1983 |
| GB | 2126106 | | | 3/1984 |
| GB | 2152063 | | | 7/1985 |
| GB | 2238660 | | | 6/1991 |
| GB | 2243381 | | | 10/1991 |
| GB | 2256023 | | | 11/1992 |
| JP | 7-300979 | | | 11/1945 |
| JP | 54-65528 | | | 5/1979 |
| JP | 57-119056 | | | 7/1982 |
| JP | 59-186336 | | | 10/1984 |
| JP | 3-169967 | | | 7/1991 |
| JP | 4-106264 | | | 4/1992 |
| JP | 5-148984 | | | 6/1993 |
| JP | 6-56310 | | | 5/1994 |
| JP | 6-146553 | | | 5/1994 |
| JP | 6-200611 | | | 7/1994 |
| JP | 6-320510 | | | 11/1994 |
| JP | 7-76923 | | | 3/1995 |
| JP | 7-180333 | | | 7/1995 |
| JP | 7-300979 | | | 11/1995 |
| JP | 7-310426 | | | 11/1995 |
| JP | 8-109734 | | | 4/1996 |
| JP | 8-270193 | | | 10/1996 |
| NE | 7 601773 | | | 2/1976 |
| NO | 157871 | | | 2/1988 |
| NO | 305614 | | | 6/1999 |
| RU | 363795 | | | 12/1972 |
| SE | 711 4900-9 | | | 9/1974 |
| SE | 450411 | | | 6/1987 |
| SE | 450141 | | | 9/1987 |
| SE | 501014 | | | 10/1994 |
| SE | 501914 | | | 6/1995 |
| SE | 502994 | | | 4/1996 |
| SE | 506254 | | | 11/1997 |
| SE | 509059 | | | 11/1998 |
| SE | 509060 | | | 11/1998 |
| SE | 512290 | | | 2/2000 |
| SE | 512313 | | | 2/2000 |
| SE | 0000200-6 | | | 8/2001 |
| WO | 93/13280 | | | 7/1983 |
| WO | 84/02155 | | | 6/1984 |
| WO | 87/03839 | | | 7/1987 |
| WO | 89/08539 | | | 9/1989 |
| WO | 92/17657 | | | 10/1992 |
| WO | 93/19910 | | | 10/1993 |
| WO | 94/01628 | | | 1/1994 |
| WO | 94/26999 | | | 11/1994 |
| WO | 94 126999 | | | 11/1994 |
| WO | 95/06176 | | | 3/1995 |
| WO | 96/27719 | | | 9/1996 |
| WO | 96/27721 | | | 9/1996 |
| WO | 96/30177 | | | 10/1996 |
| WO | 97/47834 | | | 12/1997 |
| WO | 98/24495 | | | 6/1998 |
| WO | 98/24994 | | | 6/1998 |
| WO | 98/38401 | | | 9/1998 |
| WO | 99 140273 | | | 8/1999 |
| WO | 99/66151 | | | 12/1999 |
| WO | 99 66152 | | | 12/1999 |
| WO | 00 106854 | | | 2/2000 |
| WO | WO 00/48806 | A1 | * | 8/2000 |
| WO | 00 66856 | | | 11/2000 |
| WO | 01 66876 | | | 9/2001 |

OTHER PUBLICATIONS http://en.wikipedia.org/wiki/Particle_board, printed Jun. 9, 2009, pp. 1-5 of 5.

Webster Dictionary, p. 862.

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32. Sep. 10, 2003.

U.S. Court of Appeals for the Federal Circuit Decision in *Alloc, Inc. et al.* vs. *International Trade Commission and Pergs, Inc. et al.* decided Sep. 10, 2003.

Page 2 of Article, "Holz-Lexikon".

* cited by examiner

METHOD FOR SEALING A BUILDING PANEL

FIELD OF THE INVENTION

The invention relates to a process for sealing a construction plate of wood or of a wood material having a top side and a bottom side.

BACKGROUND DESCRIPTION

Construction plates may be floor boards, such as parquet; sheathing boards, or sheets for furniture building. These plates are made of solid wood, especially doweled and glued wood, or they may consist of a core of a wood material such as MDF, HDF (medium-density fiberboard, high-density fiberboard) or floor plates onto which a real wood veneer is cemented. OSB boards (Oriented Strand Boards) are the principal sheathing boards used.

The surfaces of these plates must be sealed to protect them from environmental influences. Penetration of moisture in particular must be prevented for floor boards. The surface of the board is often painted for that purpose. Paint is relatively soft, and the paint coat is subject to wear, especially in parquet floors, so that the floor must be resealed often. In closed spaces, that is linked with unpleasant features, as the old coat of paint must be sanded off before a new one can be applied. The fine sanding dust deposits everywhere, and then must be tediously removed.

Laminated panels are sealed with a coating of synthetic resin. To produce laminated panels, a paper sheet printed with a pattern is laid on a carrier board of MDF, HDF or chipboard, on which has been laid an overlay, a layer of synthetic resin or a paper layer soaked with synthetic resin. Then the board is pressed, with heating, so that the overlay, including the paper layer, bonds to the surface of the board. For floorboards, corundum particles are incorporated in the finished overlay to increase resistance to wear. Then individual panels are sawed out of the boards so produced.

A resin is not only less expensive than paint, but also harder. Placing the paper sheet or a ready-made overlay onto the top side of the plate of wood material must be done carefully. Handling of the very thin layers is complicated and requires precisely operating machines so as to make sure that only one individual layer of the overlay is lifted from a stack. For a laminated plate, the bottom side must be given an "undercoat" that compensates for the tensile stresses produced on the plate core by the decorated layer in order to prevent bending of the plate, and especially of the panels sawed out later, in the longitudinal direction.

A parquet structure is known from EP B1-0 560 870, in which a filler resin or paint is impregnated into the interior and into the intermediate spaces of the vertical grain of the wood, under the varnish layer which forms the surface coating, so that the amount of the paint is several times greater than the amount of the parquet varnish. After the filler resin has penetrated in, the boards are preheated. After cooling they absorb the resin down to a sufficient depth to form a "barrier layer" which prevents the expensive varnish penetrating in too deeply when the parquet is later sealed. This measure provides harder surfaces than the usual sealed parquetry with the same consumption of varnish.

It is known from DE C2-37 35 368 that a powdered resin layer can be scattered on a plate of material and then pieces of inlay can be placed on that. Then the powder layer is hot-pressed to melt the resin and bond it to the plate.

SUMMARY OF THE INVENTION

Based on that statement of the problem, a process will be described for sealing a construction board of wood or a wood material with a real wood surface, with which the wear-resistant surface known for laminated plates can be attained, but which is simpler and can be carrier out faster.

DETAILED DESCRIPTION OF EMBODIMENTS OF THE INVENTION

The solution of the problem is arrived at through the following steps:

a) applying liquid resin to the top side, b) drying the resin, c) pressing the construction plate under the influence of temperature, so that the resin at least partially melts, wherein the pressing may be performed in a continuous press.

The liquid resin can be rolled on, sprayed on, or poured on. It is considerably easier to handle than a premade resin layer. If the resin layer is applied correspondingly thick, the surface hardness known for laminated plates is produced. Thus it is possible to provide a construction plate which combines the positive properties of solid wood or veneered wood material with the positive properties of a laminate. The considerably harder resin gives very high wear resistance, which can be increased even more by mixing corundum particles into the liquid resin, or by scattering them on it.

Use of appropriately polished press surfaces in the press can produce degrees of gloss on pressing the construction plate. A press plate polished to a high gloss results in highly glossy or even reflective surfaces. That can generate particularly beautiful visual effects. An OSB plate can be smoothed to eliminate unevennesses in the surface before application of the resin coating.

The bottom side of the construction plate can be sealed in the same manner. Then OSB plates in particular, which exhibit very high strength, can be used as concrete form sheets. Not only does the synthetic resin layer prevent penetration of moisture into the form sheet, but it also increases its life because of the hardness of the surface.

The resin can be applied in multiple layers, with each layer being dried before the next is applied.

It is preferable for the resin to be a synthetic resin, especially a melamine resin.

The resin can be stained to produce special visual effects. A color layer can be applied between the resin layers on the top or bottom sides. The color layer can be printed. That has the advantage that the appearance can be improved. For instance, an oak or rosewood pattern, with the appropriate grain and color, can be applied to a pine veneer, increasing the value of the real wood surface.

A relief matching the pattern (of the wood grain) can be embossed in the resin layer on pressing so as to match the feel of the sealed surface to that of the unsealed wood.

Other fillers can also be mixed into the resin layer, or sprinkled onto individual layers. Application of such a layer to the bottom side can, for instance, improve the impact sound characteristics of a floor board.

It is preferable to coat the top and bottom sides at the same time. Not only does that provide completely new and improved product properties, but it also simultaneously makes a substantial reduction in the production cost of the construction plate.

The invention claimed is:

1. A process for sealing a construction plate of wood or a wood material, having a top side and a bottom side, with the following steps:

applying multiple layers of a liquid resin on the top side, drying the resin, pressing the construction plate under the influence of temperature so that the resin at least partially melts, wherein the pressing is performed in a continuous press, and embossing a relief matching a pattern of a wood grain into the resin layer on pressing.

2. The process according to claim 1, further comprising the following steps:

application of the resin to the bottom side, drying the resin, pressing the construction plate under the influence of temperature so that the resin at least partially melts.

3. The process of claim 2, further comprising mixing fillers into the resin on the bottom side for improving impact sound characteristics of a floor board made from the plate.

4. The process according to claim 1, wherein an applied one of the multiple layers is dried before a next one of the multiple layers is applied.

5. The process according to claim 1, wherein the resin is a synthetic resin.

6. The process according to claim 5, wherein the synthetic resin is a melamine resin.

7. The process according to claim 1, wherein the resin is stained.

8. The process according to claim 1, further comprising applying a color layer between the resin layers.

9. The process of claim 8, wherein:

the color layer is printed with a wood grain pattern, and the pressing embosses the relief matching the wood grain pattern into the resin.

10. The process according to claim 1, wherein corundum is mixed into or scattered onto individual layers of the multiple layers.

11. The process according to claim 2, wherein the resin is applied simultaneously on the top side and the bottom side.

12. The process of claim 1, wherein the construction plate comprises solid wood.

13. A process for sealing a plate of wood, the plate having a top side and a bottom side, the process comprising:

simultaneously coating the top side and the bottom side with resin;

drying the resin;

pressing the plate under the influence of temperature so that the resin at least partially melts, wherein the pressing is performed in a continuous press; and applying a color layer between the resin and at least one of the top side and the bottom side, wherein the color layer is printed with a wood grain pattern and the pressing embosses a relief matching the wood grain pattern into the resin.

14. The process of claim 13, wherein:

the resin is stained to produce a visual effect, corundum particles are mixed into or scattered onto the resin, and the plate is solid wood.

15. The process of claim 13, further comprising mixing fillers into the resin on the bottom side for improving impact sound characteristics of a floor board made from the plate.

16. A process for sealing a plate of wood or wood material, the plate having a top side and a bottom side, the process comprising:

applying multiple layers of a synthetic liquid resin on the top side, wherein an applied one of the multiple layers is dried before a next one of the multiple layers is applied on the top side;

applying multiple layers of the synthetic liquid resin on the bottom side, wherein an applied one of the multiple other layers is dried before a next one of the multiple other layers is applied to the bottom side;

pressing, in a continuous press, the plate under the influence of temperature so that the synthetic liquid resin at least partially melts;

embossing a relief matching a pattern of wood grain in the synthetic liquid resin; and applying a color layer between the synthetic liquid resin layers on the top side, the color layer being printed with the wood grain pattern, wherein:

the synthetic liquid resin is stained to produce a visual effect, corundum particles are mixed or sprinkled onto individual layers of the multiple layers of the synthetic liquid resin on the top side, mixing fillers into the layers of synthetic liquid resin on the bottom side for improving impact sound characteristics of a floor board made from the plate; and the multiple layers of the synthetic liquid resin are applied simultaneously on the top side and the bottom side.

17. The process of claim 16, wherein the applying the color layer is a printing process.

18. The process of claim 17, wherein the plate of wood is OSB and prior to the applying multiple layers of the synthetic liquid resin on the top side and the bottom side, smoothing the OSB to eliminate unevenness.

19. The process of claim 18, wherein the pressing forms a glossy or reflective surface on the plate.

20. The process of claim 19, wherein the synthetic liquid resin is melamine.

21. The process of claim 17, wherein the plate is solid wood.

22. The process of claim 21, wherein the pressing forms a glossy or reflective surface on the plate.

* * * * *